US008889613B2

(12) United States Patent
Silvernail et al.

(10) Patent No.: US 8,889,613 B2
(45) Date of Patent: Nov. 18, 2014

(54) HIGH ALKALINE WAREWASH DETERGENT FOR CONTROLLING HARD WATER SCALE

(75) Inventors: Carter Silvernail, Burnsville, MN (US); Altony Miralles, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 245 days.

(21) Appl. No.: 13/211,882

(22) Filed: Aug. 17, 2011

(65) Prior Publication Data

US 2013/0045909 A1 Feb. 21, 2013

(51) Int. Cl.

| | |
|---|---|
| ***C11D 17/00*** | (2006.01) |
| ***C11D 3/37*** | (2006.01) |
| ***C11D 7/06*** | (2006.01) |
| ***C11D 3/04*** | (2006.01) |
| ***C11D 3/10*** | (2006.01) |

(52) U.S. Cl.

CPC ..... *C11D 3/3761* (2013.01); *C11D 7/06* (2013.01); *C11D 3/044* (2013.01); *C11D 3/10* (2013.01); *C11D 17/0047* (2013.01)

USPC ..... 510/475; 510/476; 510/477

(58) Field of Classification Search

None

See application file for complete search history.

(56) References Cited

U.S. PATENT DOCUMENTS

| | | | | |
|---|---|---|---|---|
| 5,273,675 | A | 12/1993 | Lein et al. | |
| 2008/0287335 | A1 * | 11/2008 | Smith | 510/220 |
| 2010/0197545 | A1 | 8/2010 | Silvernail et al. | |
| 2012/0053105 | A1 | 3/2012 | Olson et al. | |

FOREIGN PATENT DOCUMENTS

| | | |
|---|---|---|
| WO | WO2010/049187 | 5/2010 |

* cited by examiner

*Primary Examiner* — Necholus Ogden, Jr.

(74) *Attorney, Agent, or Firm* — Amy J. Hoffman

(57) ABSTRACT

A detergent comprises an alkalinity source, a homopolymer of acrylic acid or a salt thereof, a homopolymer of methacrylic acid or a salt thereof, and a homopolymer of maleic acid or a salt thereof. Suitable weight ratios include a weight ratio of the homopolymer of methacrylic acid or a salt thereof to the homopolymer of acrylic acid or a salt thereof between approximately 1:3 and approximately 3:1, a weight ratio of the homopolymer of acrylic acid or a salt thereof to the homopolymer of maleic acid or a salt thereof between approximately 3:1 and approximately 1:6, and a weight ratio of the homopolymer of methacrylic acid or a salt thereof to the homopolymer of maleic acid or a salt thereof between approximately 2:1 and approximately 1:4.

12 Claims, 1 Drawing Sheet

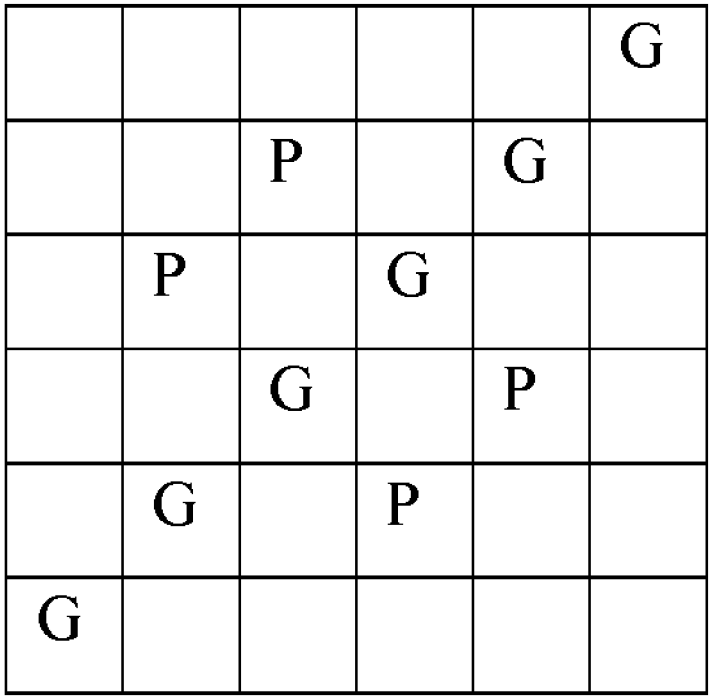

| | | | | | |
|---|---|---|---|---|---|
| | | | | | G |
| | | P | | G | |
| | P | | G | | |
| | | G | | P | |
| | G | | P | | |
| G | | | | | |

HIGH ALKALINE WAREWASH DETERGENT FOR CONTROLLING HARD WATER SCALE

TECHNICAL FIELD

The present invention is related to the field of high alkaline detergents. In particular, the present invention is related to a high alkaline detergent composition including a combination of homopolymers for controlling scale.

BACKGROUND

Conventional detergents used in warewashing include alkaline detergents. Alkaline detergents, particularly those intended for institutional use, in combination with the presence of hard water commonly result in heavy scale formation that is difficult to control, particularly in warewash applications at elevated temperatures. Alkaline detergents often contain polymers, phosphonates, and chelating agents such as nitrilotriacetic acid (NTA) and ethylenediaminetetraacetic acid (EDTA) to help control scale, remove soils, and/or sequester metal ions such as calcium, magnesium, and iron.

Chelating agents and/or threshold agents are often used in high alkaline detergents because of their ability to solubilize metal salts and/or prevent calcium, magnesium, and iron salts from precipitating. When calcium, magnesium, and iron salts precipitate, the crystals may attached to the surface being cleaned and cause undesirable effects, such as spotting or films, which give the surface an unclean appearance.

SUMMARY

One embodiment is a detergent including an alkalinity source, a homopolymer of acrylic acid or a salt thereof, a homopolymer of methacrylic acid or a salt thereof, and a homopolymer of maleic acid or a salt thereof. The exemplary detergent has a weight ratio of the homopolymer of methacrylic acid or a salt thereof to the homopolymer of acrylic acid or a salt thereof between approximately 1:3 and approximately 3:1, a weight ratio of the homopolymer of acrylic acid or a salt thereof to the homopolymer of maleic acid or a salt thereof between approximately 3:1 and approximately 1:6, and a weight ratio of the homopolymer of methacrylic acid or a salt thereof to the homopolymer of maleic acid or a salt thereof between approximately 2:1 and approximately 1:4.

Another embodiment is a detergent including between approximately 1% and approximately 75% by weight alkalinity source, between approximately 0.5% and approximately 10% by weight a homopolymer of acrylic acid or salt thereof, between approximately 0.5% and approximately 10% by weight a homopolymer of methacrylic acid or salt thereof, and between approximately 1% and approximately 10% by weight a homopolymer of maleic acid or salt thereof.

A further embodiment is a method of preparing a use solution which includes mixing water with a detergent composition to create a use solution. The detergent composition includes an alkalinity source, a homopolymer of acrylic acid or a salt thereof, a homopolymer of methacrylic acid or a salt thereof, and a homopolymer of maleic acid or a salt thereof.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

FIG. 1 is a diagram illustrating the placement of glass and plastic tumblers in Raburn rack of a 100 cycle test.

DETAILED DESCRIPTION

Detergent Compositions

The present detergent compositions provide a high alkalinity detergent including a homopolymer of acrylic acid or a salt thereof, a homopolymer of methacrylic acid or a salt thereof, and a homopolymer of maleic acid or a salt thereof. Such compositions may be particularly useful in providing hardwater scale control and preventing hardwater scale accumulation on hard surfaces such as plastic, glass, metal, and ceramic. Further, such compositions can be biodegradable and substantially free of phosphorous containing components and aminocarboxylates such as NTA and EDTA, to comply with various regulatory requirements.

The present detergent compositions can be used in any environment in which it is desirable to provide hardwater scale control. Example applications include vehicle care applications, warewashing applications, laundering applications, and food and beverage applications. More particularly, example applications include, but are not limited to: machine and manual warewashing, presoaks, laundry and textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, and industrial or household cleaners. Methods of using the detergent composition are also provided.

The detergent composition generally includes an alkalinity source, a homopolymer of acrylic acid or a salt thereof, a homopolymer of methacrylic acid or a salt thereof, and a homopolymer of maleic acid or a salt thereof. A suitable concentration range of the components in the detergent composition include between approximately 1% and approximately 75% by weight alkalinity source, between approximately 0.5% and approximately 10% by weight a homopolymer of acrylic acid or a salt thereof, between approximately 0.5% and approximately 10% by weight a homopolymer of methacrylic acid or a salt thereof, and between approximately 1% and approximately 10% by weight a homopolymer of maleic acid or a salt thereof. A particularly suitable concentration range of components in the detergent composition include between approximately 5% and approximately 70% by weight alkalinity source, between approximately 0.5% and approximately 6% by weight a homopolymer of acrylic acid or a salt thereof, between approximately 1% and approximately 6% by weight a homopolymer of methacrylic acid or a salt thereof, and between approximately 1% and approximately 6% by weight a homopolymer of maleic acid or a salt thereof.

Suitable homopolymers of acrylic acid or salts thereof may have a molecular weight between approximately 300 and approximately 25,000 grams per mol (g/mol), more particularly, from about 400 to about 15,000 g/mol. An example of a commercially available homopolymer of acrylic acid or a salt thereof includes but is not limited to Acumer™ 1000, a 2,000 molecular weight polyacrylic acid homopolymer available from Dow Chemical. Other examples of suitable homopolymers of acrylic acid or a salt thereof includes Sokalan®

PA30CL available from BASF, Aquatreat® AR250 available from Akzo Nobel, and Acusol™ 929 available from Dow Chemical.

Suitable homopolymers of methacrylic acid or salts thereof may have a molecular weight between approximately 300 and approximately 50,000 g/mol, more particularly, between approximately 400 and approximately 50,000 g/mol. An example of a commercially available homopolymer of methacrylic acid or a salt thereof includes but is not limited to Alcosperse® 125, a 10,000 molecular weight polymethacrylic acid homopolymer available from Akzo Nobel. Another example of a suitable homopolymer of polymethacrylic acid or salt thereof includes Tamol™ 960 available from Dow Chemical.

Suitable homopolymers of maleic acid or salts thereof may have a molecular weight between approximately 100 and approximately 2,500 g/mol, and more particularly between approximately 200 and approximately 2,500 g/mol. An example of a commercially available homopolymer of maleic acid or a salt thereof includes but is not limited to Belclene® 200, a 600-800 molecular weight polymaleic acid homopolymer available from BWA. Another example of a suitable homopolymer of polymaleic acid or salt thereof includes Aquatreat® AR801 available from Akzo Nobel.

A suitable weight ratio of the homopolymer of methacrylic acid or a salt thereof to the homopolymer of acrylic acid or a salt thereof is between approximately 1:3 and approximately 3:1. A particularly suitable weight ratio of the homopolymer of methacrylic acid or a salt thereof to the homopolymer of acrylic acid or a salt thereof is between approximately 1:3 and approximately 1:1. A suitable weight ratio of the homopolymer of acrylic acid or a salt thereof to the homopolymer of maleic acid or a salt thereof is between approximately 3:1 and approximately 1:6. A particularly suitable weight ratio of the homopolymer of acrylic acid or a salt thereof to the homopolymer of maleic acid or a salt thereof is between approximately 3:1 and approximately 1:1. A suitable weight ratio of the homopolymer of methacrylic acid or a salt thereof to the homopolymer of maleic acid or a salt thereof is between approximately 2:1 and approximately 1:4. A particularly suitable weight ratio of the homopolymer of methacrylic acid or a salt thereof to the homopolymer of maleic acid or a salt thereof is between approximately 3:1 and approximately 1:1.

The detergent composition also includes an alkalinity source, such as an alkali metal hydroxide or alkali metal carbonate. Examples of suitable alkalinity sources include but are not limited to: sodium hydroxide, potassium hydroxide, sodium carbonate, potassium carbonate, a mixture of alkali metal hydroxides, a mixture of alkali metal carbonates, and a mixture of alkali metal hydroxide and alkali metal carbonate. The alkali metal hydroxide may be added to the composition in any form known in the art, including as solid beads, dissolved in an aqueous solution, or a combination thereof.

The alkalinity source controls the pH of the resulting solution when water is added to the detergent composition to form a use solution. The pH of the use solution must be maintained in the alkaline range in order to provide sufficient detergency properties. In one embodiment, the pH of the use solution is between approximately 10 and approximately 13. Particularly, the pH of the use solution is between about 10 and about 12. If the pH of the use solution is too high, for example, above 13, the use solution may be too alkaline and attack or damage the surface to be cleaned.

The alkalinity source may also function as a hydratable salt to form a solid composition. The hydratable salt can be referred to as substantially anhydrous. By substantially anhydrous, it is meant that the component contains less than about 2% by weight water based upon the weight of the hydratable component. The amount of water can be less than about 1% by weight, and can be less than about 0.5% by weight. There is no requirement that the hydratable salt be completely anhydrous.

The detergent composition also includes water of hydration to hydrate the alkalinity source/hydratable salt. It should be understood that the reference to water includes both water of hydration and free water. The phrase "water of hydration" refers to water which is somehow attractively bound to a non-water molecule. An exemplary form of attraction includes hydrogen bonding. The water of hydration also functions to increase the viscosity of the mixture during processing and cooling to prevent separation of the components. The amount of water of hydration in the detergent composition will depend on the alkalinity source/hydratable salt. In addition to water of hydration, the detergent composition may also have free water which isn't attractively bound to a non-water molecule.

In one embodiment, the detergent composition may comprise, consist essentially of or consist of the previously described components. In other embodiments, the detergent composition may further include a surfactant or surfactant system. A variety of surfactants can be used in a detergent composition, including, but not limited to: anionic, nonionic, cationic, and zwitterionic surfactants. Surfactants are an optional component of the detergent composition and can be excluded from the concentrate. Exemplary surfactants that can be used are commercially available from a number of sources. For a discussion of surfactants, see Kirk-Othmer, *Encyclopedia of Chemical Technology*, Third Edition, volume 8, pages 900-912. When the detergent composition includes a surfactant as a cleaning agent, the cleaning agent is provided in an amount effective to provide a desired level of cleaning The detergent composition, when provided as a concentrate, can include the surfactant cleaning agent in a range of about 0.05% to about 20% by weight, about 0.5% to about 15% by weight, about 1% to about 15% by weight, about 1.5% to about 10% by weight, and about 2% to about 8% by weight. Additional exemplary ranges of surfactant in a concentrate include about 0.5% to about 8% by weight, and about 1% to about 5% by weight.

Examples of anionic surfactants useful in the detergent composition include, but are not limited to: carboxylates such as alkylcarboxylates and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, and alkylether sulfates. Exemplary anionic surfactants include, but are not limited to: sodium alkylarylsulfonate, alpha-olefinsulfonate, and fatty alcohol sulfates.

Examples of nonionic surfactants useful in the detergent composition include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block copolymers. An example of a commercially available ethylene oxide/propylene oxide block copolymer includes, but is not limited to, PLURONIC®, available from BASF Corporation, Florham Park, N.J. An example of a commercially available silicone surfactant includes, but is not limited to, ABIL® B8852, available from Goldschmidt Chemical Corporation, Hopewell, Va. A particularly suitable surfactant is D500, an ethylene oxide/propylene oxide copolymer available from BASF Corporation, Florham Park, N.J.

Examples of cationic surfactants that can be used in the detergent composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride. The cationic surfactant can be used to provide sanitizing properties.

Examples of zwitterionic surfactants that can be used in the detergent composition include, but are not limited to: betaines, imidazolines, and propionates.

When the detergent composition is intended to be used in an automatic dishwashing or warewashing machine, the surfactants selected, if any surfactant is used, can be those that provide an acceptable level of foaming when used inside a dishwashing or warewashing machine. Detergent compositions for use in automatic dishwashing or warewashing machines are generally considered to be low-foaming compositions. Low foaming surfactants that provide the desired level of detersive activity are advantageous in an environment such as a dishwashing machine where the presence of large amounts of foaming can be problematic. In addition to selecting low foaming surfactants, defoaming agents can also be utilized to reduce the generation of foam. Accordingly, surfactants that are considered low foaming surfactants can be used. In addition, other surfactants can be used in conjunction with a defoaming agent to control the level of foaming.

The detergent composition can be phosphorus-free and/or nitrilotriacetic acid (NTA)-free to make the detergent composition more environmentally beneficial. Phosphorus-free means a composition having less than approximately 0.5 wt %, more particularly less than approximately 0.1 wt %, and even more particularly less than approximately 0.01 wt % phosphorous based on the total weight of the composition. NTA-free means a composition having less than approximately 0.5 wt %, less than approximately 0.1 wt %, and particularly less than approximately 0.01 wt % NTA based on the total weight of the composition. When the composition is NTA-free, it is also compatible with chlorine, which functions as an anti-redeposition and stain-removal agent.

Additional Functional Materials

The detergent composition can also include various additional functional components. In some embodiments, the alkaline source, the homopolymers and/or the optional surfactant make up a large amount, or even substantially all of the total weight of the detergent composition, for example, in embodiments having few or no additional functional materials disposed therein. In these embodiments, the component concentration ranges provided above for the detergent are representative of the ranges of those same components in the detergent composition.

The functional materials provide desired properties and functionalities to the detergent composition. For the purpose of this application, the term "functional materials" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional materials may be used. Moreover, the components discussed above may be multi-functional and may also provide several of the functional benefits discussed below.

Secondary Alkali Source

The detergent composition can include one or more secondary alkali sources. Examples of suitable secondary alkali sources of the detergent composition include, but are not limited to alkali metal carbonates, alkali metal hydroxides and alkali metal silicates. Exemplary alkali metal carbonates that can be used include, but are not limited to: sodium or potassium carbonate, bicarbonate, sesquicarbonate, and mixtures thereof. Exemplary alkali metal hydroxides that can be used include, but are not limited to: sodium or potassium hydroxide. The alkali metal hydroxide may be added to the composition in any form known in the art, including as solid beads, dissolved in an aqueous solution, or a combination thereof. Examples of alkali metal silicates include, but are not limited to sodium or potassium silicate or polysoilicate, sodium or potassium metasilicate and hydrated sodium or potassium metasilicate or a combination thereof.

Builders or Water Conditioners

The detergent composition can include one or more building agents, also called chelating or sequestering agents (e.g., builders), including, but not limited to: condensed phosphates, alkali metal carbonates, phosphonates, aminocarboxylic acids, and/or polyacrylates. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are between about 0.1% to about 70% by weight, about 1% to about 60% by weight, or about 1.5% to about 50% by weight. If the solid detergent is provided as a concentrate, the concentrate can include between approximately 1% to approximately 60% by weight, between approximately 3% to approximately 50% by weight, and between approximately 6% to approximately 45% by weight of the builders. Additional ranges of the builders include between approximately 3% to approximately 20% by weight, between approximately 6% to approximately 15% by weight, between approximately 25% to approximately 50% by weight, and between approximately 35% to approximately 45% by weight.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the detergent composition by fixing the free water present in the composition as water of hydration.

Examples of phosphonates include, but are not limited to: 2-phosphonobutane-1,2,4-tricarboxylic acid (PBTC), 1-hydroxyethane-1,1-diphosphonic acid, $CH_2C(OH)[PO(OH)_2]$ $_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine(pentamethylenephosphonic acid), $(HO_2)POCH_2N[(CH_2)_2N[CH_2PO(OH)_2]_2]_2$; and phosphorus acid, $H_3PO_3$. A preferred phosphonate combination is ATMP and DTPMP. A neutralized or alkali phosphonate, or a combination of the phosphonate with an alkali source prior to being added into the mixture such that there is little or no heat or gas generated by a neutralization reaction when the phosphonate is added is preferred. In one embodiment, however, the detergent composition is phosphorous-free.

Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent. In one embodiment, however, the composition is free of aminocarboxylates.

Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate ($-CO_2^-$) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. Other suitable water conditioning polymers include starch, sugar or polyols comprising carboxylic acid or ester functional groups. Exemplary carboxylic acids include but are not limited to maleic, acrylic, methacrylic and itaconic acid or salts thereof. Exemplary ester functional groups include aryl, cyclic, aromatic and $C_1$-$C_{10}$ linear, branched or substituted esters. For a further discussion of chelating agents/sequestrants, see Kirk-Othmer, *Encyclopedia of Chemical Technology*, Third Edition, volume 5, pages 339-366 and volume 23, pages 319-320, the disclosure of which is incorporated by reference herein. These materials may also be used at substoichiometric levels to function as crystal modifiers Hardening Agents The detergent compositions can also include a hardening agent in addition to, or in the form of, the builder. A hardening agent is a compound or system of compounds, organic or inorganic, which significantly contributes to the uniform solidification of the composition. Preferably, the hardening agents are compatible with the cleaning agent and other active ingredients of the composition and are capable of providing an effective amount of hardness and/or aqueous solubility to the processed composition. The hardening agents should also be capable of forming a homogeneous matrix with the cleaning agent and other ingredients when mixed and solidified to provide a uniform dissolution of the cleaning agent from the detergent composition during use.

The amount of hardening agent included in the detergent composition will vary according to factors including, but not limited to: the type of detergent composition being prepared, the ingredients of the detergent composition, the intended use of the composition, the quantity of dispensing solution applied to the solid composition over time during use, the temperature of the dispensing solution, the hardness of the dispensing solution, the physical size of the detergent composition, the concentration of the other ingredients, and the concentration of the cleaning agent in the composition. It is preferred that the amount of the hardening agent included in the detergent composition is effective to combine with the cleaning agent and other ingredients of the composition to form a homogeneous mixture under continuous mixing conditions and a temperature at or below the melting temperature of the hardening agent.

It is also preferred that the hardening agent form a matrix with the cleaning agent and other ingredients which will harden to a solid form under ambient temperatures of approximately 30° C. to approximately 50° C., particularly approximately 35° C. to approximately 45° C., after mixing ceases and the mixture is dispensed from the mixing system, within approximately 1 minute to approximately 3 hours, particularly approximately 2 minutes to approximately 2 hours, and particularly approximately 5 minutes to approximately 1 hour. A minimal amount of heat from an external source may be applied to the mixture to facilitate processing of the mixture. It is preferred that the amount of the hardening agent included in the detergent composition is effective to provide a desired hardness and desired rate of controlled solubility of the processed composition when placed in an aqueous medium to achieve a desired rate of dispensing the cleaning agent from the solidified composition during use.

The hardening agent may be an organic or an inorganic hardening agent. A preferred organic hardening agent is a polyethylene glycol (PEG) compound. The solidification rate of detergent compositions comprising a polyethylene glycol hardening agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, particularly approximately 30 to approximately 1700. Typically, the polyethylene glycol is a solid in the form of a free-flowing powder or flakes, having a molecular weight of approximately 1,000 to approximately 100,000, particularly having a molecular weight of at least approximately 1,450 to approximately 20,000, more particularly between approximately 1,450 to approximately 8,000. The polyethylene glycol is present at a concentration of from approximately 1% to 75% by weight and particularly approximately 3% to approximately 15% by weight. Suitable polyethylene glycol compounds include, but are not limited to: PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Preferred inorganic hardening agents are hydratable inorganic salts, including, but not limited to: sulfates and bicarbonates. The inorganic hardening agents are present at concentrations of up to approximately 50% by weight, particularly approximately 5% to approximately 25% by weight, and more particularly approximately 5% to approximately 15% by weight. In one embodiment, however, the solid composition if free of sulfates and carbonates including soda ash.

Urea particles can also be employed as hardeners in the detergent compositions. The solidification rate of the compositions will vary, at least in part, to factors including, but not limited to: the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the detergent composition is effective to provide a desired hardness and desired rate of solubility of the composition when placed in an aqueous medium to achieve a desired rate of dispensing the cleaning agent from the solidified composition during use. In some embodiments, the composition includes between approximately 5% to approximately 90% by weight urea, particularly between approximately 8% and approximately 40% by weight urea, and more particularly between approximately 10% and approximately 30% by weight urea.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Bleaching Agents

Bleaching agents suitable for use in the detergent composition for lightening or whitening a substrate include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the detergent compositions include, but are not limited to: chlorine-containing compounds such as chlorine, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine. When the concentrate includes a bleaching agent, it can be included in an amount of between approximately 0.1% and approximately 60% by weight, between approximately 1% and approximately 20% by weight, between approximately 3% and approximately 8% by weight, and between approximately 3% and approximately 6% by weight.

Fillers

The detergent composition can include an effective amount of detergent fillers which do not perform as a cleaning agent per se, but cooperates with the cleaning agent to enhance the overall cleaning capacity of the composition. Examples of detergent fillers suitable for use in the present cleaning compositions include, but are not limited to: sodium sulfate and sodium chloride. When the concentrate includes a detergent filler, it can be included in an amount up to approximately 50% by weight, between approximately 1% and approximately 30% by weight, or between approximately 1.5% and approximately 25% by weight.

Defoaming Agents

A defoaming agent for reducing the stability of foam may also be included in the warewashing composition. Examples of defoaming agents include, but are not limited to: ethylene oxide/propylene block copolymers such as those available under the name Pluronic® N-3 available from BASF Corporation, Florham Park, N.J.; silicone compounds such as silica dispersed in polydimethylsiloxane, polydimethylsiloxane, and functionalized polydimethylsiloxane such as those available under the name Abil® B9952 available from Goldschmidt Chemical Corporation, Hopewell, Va.; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated herein by reference. When the concentrate includes a defoaming agent, the defoaming agent can be provided in an amount of between approximately 0.0001% and approximately 10% by weight, between approximately 0.001% and approximately 5% by weight, or between approximately 0.01% and approximately 1.0% by weight.

Anti-Redeposit Ion Agents

The detergent composition can include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride copolymers, cellulosic derivatives such as hydroxyethyl cellulose, hydroxypropyl cellulose and carboxymethyl cellulose. When the concentrate includes an anti-redeposition agent, the anti-redeposition agent can be included in an amount of between approximately 0.5% and approximately 10% by weight, and between approximately 1% and approximately 5% by weight.

Stabilizing Agents

The detergent composition may also include stabilizing agents. Examples of suitable stabilizing agents include, but are not limited to: borate, calcium/magnesium ions, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to approximately 20% by weight, between approximately 0.5% and approximately 15% by weight, and between approximately 2% and approximately 10% by weight.

Dispersants

The detergent composition may also include dispersants. Examples of suitable dispersants that can be used in the detergent composition include, but are not limited to: maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the concentrate can be up to approximately 20% by weight, between approximately 0.5% and approximately 15% by weight, and between approximately 2% and approximately 9% by weight.

Enzymes

Enzymes that can be included in the detergent composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus* licheniformix, *Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the detergent composition is provided as a use composition. Exemplary ranges of the enzyme in the concentrate include up to approximately 15% by weight, between approximately 0.5% to approximately 10% by weight, and between approximately 1% to approximately 5% by weight.

Glass and Metal Corrosion Inhibitors

The detergent composition can include a metal corrosion inhibitor in an amount up to approximately 50% by weight, between approximately 1% and approximately 40% by weight, or between approximately 3% and approximately 30% by weight. The corrosion inhibitor is included in the detergent composition in an amount sufficient to provide a use solution that exhibits a rate of corrosion and/or etching of glass that is less than the rate of corrosion and/or etching of glass for an otherwise identical use solution except for the absence of the corrosion inhibitor. It is expected that the use solution will include at least approximately 6 parts per million (ppm) of the corrosion inhibitor to provide desired corrosion inhibition properties. It is expected that larger amounts of corrosion inhibitor can be used in the use solution without deleterious effects. It is expected that at a certain point, the additive effect of increased corrosion and/or etching resistance with increasing corrosion inhibitor concentration will be lost, and additional corrosion inhibitor will simply increase the cost of using the detergent composition. The use solution can include between approximately 6 ppm and approximately 300 ppm of the corrosion inhibitor, and between approximately 20 ppm and approximately 200 ppm of the corrosion inhibitor. Examples of suitable corrosion inhibitors include, but are not limited to: a combination of a source of aluminum ion and a source of zinc ion, as well as an alkali metal silicate or hydrate thereof.

The corrosion inhibitor can refer to the combination of a source of aluminum ion and a source of zinc ion. The source of aluminum ion and the source of zinc ion provide aluminum ion and zinc ion, respectively, when the detergent composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof. Exemplary sources of aluminum ion include, but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, and aluminum phosphate. Exemplary sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate.

The applicants discovered that by controlling the ratio of the aluminum ion to the zinc ion in the use solution, it is possible to provide reduced corrosion and/or etching of glassware and ceramics compared with the use of either component alone. That is, the combination of the aluminum ion and the zinc ion can provide a synergy in the reduction of corrosion and/or etching. The ratio of the source of aluminum ion to the source of zinc ion can be controlled to provide a synergistic effect. In general, the weight ratio of aluminum ion to zinc ion in the use solution can be between at least approximately 6:1, can be less than approximately 1:20, and can be between approximately 2:1 and approximately 1:15.

Fragrances and Dyes

Various dyes, odorants including perfumes, and other aesthetic enhancing agents can also be included in the composition. Suitable dyes that may be included to alter the appearance of the composition, include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Fragrances or perfumes that may be included in the compositions include, but are not limited to: terpenoids such as citronellol, aldehydes such as amyl cinnamaldehyde, a jasmine such as C1S-jasmine or jasmal, and vanillin.

Thickeners

The detergent compositions can include a rheology modifier or a thickener. The rheology modifier may provide the following functions: increasing the viscosity of the compositions; increasing the particle size of liquid use solutions when dispensed through a spray nozzle; providing the use solutions with vertical cling to surfaces; providing particle suspension within the use solutions; or reducing the evaporation rate of the use solutions.

The rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, particularly five minutes or more.

Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, cross-linked, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol, available from Rohm & Haas Company, Philadelphia, Pa.; and Carbopol, available from B.F. Goodrich, Charlotte, N.C.

Examples of suitable polymeric thickeners include, but not limited to: polysaccharides. An example of a suitable commercially available polysaccharide includes, but is not limited to, Diutan, available from Kelco Division of Merck, San Diego, Calif. Thickeners for use in the detergent compositions further include polyvinyl alcohol thickeners, such as, fully hydrolyzed (greater than 98.5 mol acetate replaced with the —OH function).

An example of a particularly suitable polysaccharide includes, but is not limited to, xanthans. Such xanthan polymers are preferred due to their high water solubility, and great thickening power. Xanthan is an extracellular polysaccharide of *xanthomonas campestras*. Xanthan may be made by fermentation based on corn sugar or other corn sweetener byproducts. Xanthan comprises a poly beta-(1-4)-D-Glucopyranosyl backbone chain, similar to that found in cellulose. Aqueous dispersions of xanthan gum and its derivatives exhibit novel and remarkable rheological properties. Low concentrations of the gum have relatively high viscosities which permit it to be used economically. Xanthan gum solutions exhibit high pseudo plasticity, i.e. over a wide range of concentrations, rapid shear thinning occurs that is generally understood to be instantaneously reversible. Non-sheared materials have viscosities that appear to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as Al+3, Fe+3, Sb+3, Zr+4 and other transition metals. Examples of suitable commercially available xanthans include, but are not limited to KELTROL®, KELZAN® AR, KELZAN® D35, KELZAN® S, KELZAN® XZ, available from Kelco Division of Merck, San Diego, Calif. Known organic crosslinking agents can also be used. A preferred crosslinked xanthan is KELZAN® AR, which provides a pseudo plastic use solution that can produce large particle size mist or aerosol when sprayed.

Methods of Manufacture

In general, the detergent composition of the present invention can be created by combining the alkalinity source, a homopolymer of acrylic acid or a salt thereof, a homopolymer of methacrylic acid or a salt thereof, and a homopolymer of maleic acid or a salt thereof, water and any additional functional components and allowing the components to interact and solidify.

The alkalinity source, the homopolymers, and any additional functional components can harden into solid form due to the chemical reaction of the alkalinity source with the water. The solidification process may last from a few minutes to about six hours, depending on factors including, but not limited to: the size of the formed or cast composition, the ingredients of the composition, and the temperature of the composition.

The solid detergent compositions may be formed using a batch or continuous mixing system. In an exemplary embodiment, a single- or twin-screw extruder is used to combine and mix one or more cleaning agents at high shear to form a homogeneous mixture. In some embodiments, the processing temperature is at or below the melting temperature of the components. The processed mixture may be dispensed from the mixer by forming, casting or other suitable means, whereupon the detergent composition hardens to a solid form. The structure of the matrix may be characterized according to its hardness, melting point, material distribution, crystal structure, and other like properties according to known methods in the art. Generally, a solid detergent composition processed according to the method of the invention is substantially homogeneous with regard to the distribution of ingredients throughout its mass and is dimensionally stable.

In an extrusion process, the liquid and solid components are introduced into final mixing system and are continuously mixed until the components form a substantially homogeneous semi-solid mixture in which the components are distributed throughout its mass. The mixture is then discharged from the mixing system into, or through, a die or other shaping means. The product is then packaged. In an exemplary embodiment, the formed composition begins to harden to a solid form in between approximately 1 minute and approximately 3 hours. Particularly, the formed composition begins to harden to a solid form in between approximately 1 minute and approximately 2 hours. More particularly, the formed composition begins to harden to a solid form in between approximately 1 minute and approximately 20 minutes.

In a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast composition begins to harden to a solid form in between approximately 1 minute and approximately 3 hours. Particularly, the cast composition begins to harden to a solid form in between approximately 1 minute and approximately 2 hours. More particularly, the cast composition begins to harden to a solid form in between approximately 1 minute and approximately 20 minutes.

By the term "solid", it is meant that the hardened composition will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition. In general, it is expected that the detergent composition will remain in solid form when exposed to temperatures of up to approximately 100° F. and particularly up to approximately 120° F.

The resulting solid detergent composition may take forms including, but not limited to: a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the solidification matrix have a weight of between approximately 50 grams and approximately 250 grams, extruded solids formed by the composition have a weight of approximately 100 grams or greater, and solid block detergents formed by the composition have a mass of between approximately 1 and approximately 10 kilograms. The solid compositions provide for a stabilized source of functional materials. In some embodiments, the solid composition may be dissolved, for example, in an aqueous or other medium, to create a concentrated and/or use solution. The solution may be directed to a storage reservoir for later use and/or dilution, or may be applied directly to a point of use.

In certain embodiments, the solid detergent composition is provided in the form of a unit dose. A unit dose refers to a solid detergent composition unit sized so that the entire unit is used during a single washing cycle. When the solid detergent composition is provided as a unit dose, it is typically provided as a cast solid, an extruded pellet, or a tablet having a size of between approximately 1 gram and approximately 50 grams.

In other embodiments, the solid detergent composition is provided in the form of a multiple-use solid, such as a block or a plurality of pellets, and can be repeatedly used to generate aqueous detergent compositions for multiple washing cycles. In certain embodiments, the solid detergent composition is provided as a cast solid, an extruded block, or a tablet having a mass of between approximately 5 grams and approximately 10 kilograms. In certain embodiments, a multiple-use form of the solid detergent composition has a mass between approximately 1 kilogram and approximately 10 kilograms. In further embodiments, a multiple-use form of the solid detergent composition has a mass of between approximately 5 kilograms and about approximately 8 kilograms. In other embodiments, a multiple-use form of the solid detergent composition has a mass of between about approximately 5 grams and approximately 1 kilogram, or between approximately 5 grams and approximately 500 grams.

Although the detergent composition is discussed as being formed into a solid product, the detergent composition may also be provided in the form of a paste or liquid. When the concentrate is provided in the form of a paste, enough water is added to the detergent composition such that complete solidification of the detergent composition is precluded. In addition, dispersants and other components may be incorporated into the detergent composition in order to maintain a desired distribution of components.

Methods of Use

The detergent compositions can include concentrate compositions or can be diluted to form use compositions. In general, a concentrate refers to a composition that is intended to be diluted with water to provide a use solution that contacts an object to provide the desired cleaning, rinsing, or the like. The detergent composition that contacts the articles to be washed can be referred to as the use composition. The use solution can include additional functional ingredients at a level suitable for cleaning, rinsing, or the like.

A use solution may be prepared from the concentrate by diluting the concentrate with water at a dilution ratio that provides a use solution having desired detersive properties. The water that is used to dilute the concentrate to form the use composition can be referred to as water of dilution or a dilutent, and can vary from one location to another. The typical dilution factor is between approximately 1 and approximately 10,000 but will depend on factors including water hardness, the amount of soil to be removed and the like. In one embodiment, the concentrate is diluted at a ratio of between about 1:10 and about 1:1000 concentrate to water. Particularly, the concentrate is diluted at a ratio of between about 1:100 and about 1:5000 concentrate to water. More particularly, the concentrate is diluted at a ratio of between about 1:250 and 1:2000 concentrate to water.

A suitable concentration range of the components in the use solution include between about 1 and 1,000 parts-per-million (ppm) alkalinity source, between about 1 and 150 ppm homopolymer of acrylic acid or a salt thereof, between about 1 and 150 ppm homopolymer of methacrylic acid or a salt thereof, and between about 1 and 150 ppm homopolymer of maleic acid or a salt thereof. A particularly suitable concentration range of components in the use solution include between about 1 and 600 ppm alkalinity source, between about 1 and 75 ppm homopolymer of acrylic acid or a salt thereof, between about 1 and 75 ppm homopolymer of methacrylic acid or a salt thereof, and between about 1 and 75 ppm homopolymer of maleic acid or a salt thereof. A more particularly suitable concentration range of components in the use solution include between about 1 and 400 ppm alkalinity source, between about 1 and 50 ppm homopolymer of acrylic acid or a salt thereof, between about 1 and 50 ppm homopolymer of methacrylic acid or a salt thereof, and between about 1 and 50 ppm homopolymer of maleic acid or a salt thereof.

The use solution can have an elevated temperature. In one example, a use solution having a temperature between approximately 140° F. and approximately 185° F. is contacted with the substrate to be cleaned. In another example, a use solution having a temperature between approximately 150° F. and approximately 160° F. is contacted with the substrate to be cleaned.

EXAMPLES

The present invention is more particularly described in the following examples that are intended as illustrations only, since numerous modifications and variations within the scope of the present invention will be apparent to those of skill in the art. Unless otherwise noted, all parts, percentages, and ratios reported in the following examples are on a weight basis, and all reagents used in the examples were obtained or are available from the chemical suppliers described below or may be synthesized by conventional techniques.

Materials Used

D500: ethylene oxide/propylene oxide copolymer available from BASF Corporation, Florham Park, N.J.

Alcosperse® 125: a 10,000 molecular weight polymethacrylic acid homopolymer, 30% active, available from Akzo Nobel, Chicago, Ill.

Acumer™ 1000: a 2,000 molecular weight polyacrylic acid homopolymer, 50% active, available from Dow Chemical, Midland, Mich.

Belclene® 200: a 600-800 molecular weight polymaleic acid homopolymer, 50% active, available from BWA Water Additives, Tucker, Ga.

100 Cycle Warewashing Test

To determine the ability of various detergent compositions to remove spots and film from ware, six Libby 10 oz. glass tumblers were prepared by removing all film and foreign material from the surfaces of the glasses. A Hobart AM-15 warewash machine was then filled with an appropriate amount of water and the water was tested for hardness. After recording the hardness value, the tank heaters were turned on. On the day of the experiments, the water hardness was 17 grains. The warewash machine was turned on and wash/rinse cycles were run through the machine until a wash temperature of between about 150° F. and about 160° F. and a rinse temperature of between about 175° F. and about 190° F. were reached. The controller was then set to dispense an appropriate amount of detergent into the wash tank. The detergent was dispensed such that when the detergent was mixed with water during the cycle to form a use solution, the detergent concentration in the use solution was 750 parts per million (ppm). The solution in the wash tank was titrated to verify detergent concentration. The warewash machine had a washbath volume of 58 liters, a rinse volume of 2.8 liters, a washtime of 50 seconds, and a rinse time of 9 seconds.

The six clean glass tumblers were placed diagonally in a Raburn rack and four Newport 10 oz. plastic tumblers were placed off-diagonally in the Raburn rack (see FIG. 1 for arrangement) and the rack was placed inside the warewash machine. (P=plastic tumbler; G=glass tumbler).

The 100 cycle test was then started. At the beginning of each wash cycle, the appropriate amount of detergent was automatically dispensed into the warewash machine to maintain the initial detergent concentration. The detergent concentration was controlled by conductivity.

Upon completion of 100 cycles, the rack was removed from the warewash machine and the glass and plastic tumblers were allowed to dry. The glass and plastic tumblers were then graded for spot and film accumulation using an analytical light box evaluation. The light box test used a digital camera, a light box, a light source, a light meter and a control computer employing "Spot Advance" and "Image Pro Plus" commercial software. A glass to be evaluated was placed on its side on the light box, and the intensity of the light source was adjusted to a predetermined value using the light meter. A photographic image of the glass was taken and saved to the computer. The software was then used to analyze the upper half of the glass, and the computer displayed a histogram graph with the area under the graph being proportional to the thickness of the film.

Generally, a lower light box score indicates that more light was able to pass through the tumbler. Thus, the lower the light box score, the more effective the composition was at preventing scale on the surface of the tumbler. A clean, unused glass tumbler has a light box score of approximately 12,000, which corresponds to a score of 72,000 for the six glass tumblers, and a clean, unused plastic tumbler has a light box score of approximately 25,500, which corresponds to a light box score of approximately 102,000 for the four plastic tumblers. The minimum obtainable light box score (i.e., sum of six clean glass tumblers and four clean plastic tumblers) is approximately 174,000. Generally, a detergent composition is considered effective for controlling hard water scale if the sum of the light box scores for six glass tumblers and four plastic tumblers is approximately 360,000 or less.

Examples 1-4 and Comparative Examples A-F

Examples 1-4 included varying ratios of a homopolymer of methacrylic acid (Alcosperse 125), a homopolymer of acrylic acid (Acumer 1000), and a homopolymer of maleic acid (Belclene). In comparison, Comparative Examples A-F included one or two of the homopolymers of Examples 1-4 but did not include all three homopolymers. The component concentrations of the detergent compositions of Examples 1-4 and Comparative Examples A-F are presented below in Table 1.

TABLE 1

| | Ex. 1 | Ex. 2 | Ex. 3 | Ex. 4 | Comp. Ex. A | Comp. Ex. B | Comp. Ex. C | Comp. Ex. D | Comp. Ex. E | Comp. Ex. F |
|---|---|---|---|---|---|---|---|---|---|---|
| Sodium hydroxide beads (wt %) | 66 | 66 | 66 | 66 | 66 | 66 | 66 | 66 | 66 | 66 |
| D500 (wt %) | 2.2 | 2.2 | 2.2 | 2.2 | 2.2 | 2.2 | 2.2 | 2.2 | 2.2 | 2.2 |
| Alcosperse 125, 30% (wt %) | 7.2 | 3.1 | 18.6 | 6.6 | 27.2 | 0 | 0 | 13.6 | 13.6 | 0 |
| Acumer 1000, 50% (wt %) | 8.8 | 11.2 | 1.86 | 1.97 | 0 | 16.3 | 0 | 8.2 | 0 | 8.15 |
| Belclene 200, 50% (wt %) | 3.2 | 3.2 | 3.2 | 10.36 | 0 | 0 | 16.3 | 0 | 8.2 | 8.15 |
| Water (wt %) | 12.6 | 14.3 | 8.14 | 12.87 | 4.6 | 15.5 | 15.5 | 10 | 10 | 15.5 |
| Total (wt %) | 100 | 100 | 100 | 100 | 100 | 100 | 100 | 100 | 100 | 100 |
| Active (wt %) | 8.16 | 8.13 | 8.11 | 8.15 | 8.16 | 8.15 | 8.15 | 8.18 | 8.18 | 8.15 |

TABLE 1-continued

| | Ex. 1 | Ex. 2 | Ex. 3 | Ex. 4 | Comp. Ex. A | Comp. Ex. B | Comp. Ex. C | Comp. Ex. D | Comp. Ex. E | Comp. Ex. F |
|---|---|---|---|---|---|---|---|---|---|---|
| Total Water (wt %) | 23.64 | 23.67 | 23.69 | 23.66 | 23.64 | 23.65 | 23.65 | 23.62 | 23.62 | 23.65 |

Table 2 presents the light box score of each glass tumbler, and Table 3 presents the light box score of each plastic tumbler.

TABLE 2

| | Glass 1 | Glass 2 | Glass 3 | Glass 4 | Glass 5 | Glass 6 |
|---|---|---|---|---|---|---|
| Ex. 1 | 30055.57 | 37960.06 | 49243.02 | 35031.94 | 32452.87 | 32861.37 |
| Ex. 2 | 50595.87 | 50452.29 | 57891.28 | 60766.03 | 48765.03 | 47347.44 |
| Ex. 3 | 44250.45 | 42433.33 | 42110.16 | 45344.22 | 44401.59 | 41567.25 |
| Ex. 4 | 39451.22 | 42344.11 | 40038.63 | 41958.95 | 37329.40 | 45512.00 |
| Comp. Ex. A | 60085.86 | 60238.74 | 63660.82 | 64459.90 | 62160.34 | 64603.53 |
| Comp. Ex. B | 46047.71 | 56135.78 | 60439.48 | 61798.03 | 60476.30 | 57178.74 |
| Comp. Ex. C | 36085.81 | 41379.00 | 50218.21 | 49881.44 | 37475.67 | 37740.37 |
| Comp. Ex. D | 46592.91 | 54102.69 | 54597.16 | 48885.69 | 53986.40 | 62249.61 |
| Comp. Ex. E | 42332.12 | 46543.27 | 38761.55 | 49821.44 | 48554.20 | 47721.88 |
| Comp. Ex. F | 41905.61 | 50092.74 | 57432.96 | 55119.20 | 54341.21 | 31574.01 |

TABLE3

| | Plastic 1 | Plastic 2 | Plastic 3 | Plastic 4 |
|---|---|---|---|---|
| Ex. 1 | 33434.76 | 31352.91 | 30178.97 | 30350.03 |
| Ex. 2 | 25654.32 | 24282.08 | 23781.8 | 29342.5 |
| Ex. 3 | 24007.82 | 27092.48 | 27335.62 | 25366.44 |
| Ex. 4 | 20740.88 | 21302.72 | 24825.39 | 22453.11 |
| Comp. Ex. A | 38164.18 | 33598.12 | 35293.71 | 34906.81 |
| Comp. Ex. B | 31987.68 | 38362.22 | 32274.02 | 3290.75 |
| Comp. Ex. C | 31862.68 | 29470.84 | 31243.21 | 37244.73 |
| Comp. Ex. D | 65535 | 65535 | 65535 | 65535 |
| Comp. Ex. E | 28762.98 | 27998.24 | 26737.44 | 27980.62 |
| Comp. Ex. F | 23911.86 | 24310.45 | 26334.41 | 24076.43 |

A percentage difference is calculated by dividing the difference of two values by the average of the two values. As described above, a clean, unused glass tumbler had a light box score of about 12,000. Thus, the percentage difference of the light box scores for the glass tumbler after 100 cycles and a clean, unused glass tumbler are: 101% for Example 1, 126% for Example 2, 113% for Example 3, and 110% for Example 4. Similarity, a clean, unused plastic tumbler had a light box score of about 25,500, and the percentage difference of the light box scores for the plastic tumbler after 100 cycles and a clean, unused plastic tumbler are: 21% for Example 1, 1% for Example 2, 2% for Example 3 and 13% for Example 4.

Table 4 summarizes the weight ratio of the homopolymer of methacrylic acid to the homopolymer of acrylic acid to the homopolymer of maleic acid and presents the overall light box score for each composition (i.e., the sum of all tumblers).

TABLE 4

| | Methacrylic:acrylic:maleic wt ratio | Overall score |
|---|---|---|
| Ex. 1 | 1.3:2.8:1.0 | 342921.5 |
| Ex. 2 | 1.0:6.2:1.7 | 418878.64 |
| Ex. 3 | 6:1.0:1.7 | 363909.36 |
| Ex. 4 | 1:1.0:5.3 | 335956.45 |
| Comp. Ex. A | 1.0:0:0 | 517172.01 |
| Comp. Ex. B | 0:1.0:0 | 476990.71 |

TABLE 4-continued

| | Methacrylic:acrylic:maleic wt ratio | Overall score |
|---|---|---|
| Comp. Ex. C | 0:0:1.0 | 382601.96 |
| Comp. Ex. D | 1:1:0 | 582554.46 |
| Comp. Ex. E | 1:0:1 | 385213.74 |
| Comp. Ex. F | 0:1:1 | 389098.88 |

As seen in Tables 2, 3, and 4, Examples 1-4, which included all three homopolymers (a homopolymer of methacrylic acid, a homopolymer of acrylic acid, and a homopolymer of maleic acid) were more effective at removing scale than compositions that included only one or two of the components.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The invention claimed is:

1. A detergent comprising:

an alkalinity source;

a homopolymer of acrylic acid or a salt thereof;

a homopolymer of methacrylic acid or a salt thereof; and a homopolymer of maleic acid or a salt thereof, wherein a weight ratio of the homopolymer of methacrylic acid or a salt thereof to the homopolymer of acrylic acid or a salt thereof is between approximately 1:3 and approximately 3:1, a weight ratio of the homopolymer of acrylic acid or a salt thereof to the homopolymer of maleic acid or a salt thereof is between approximately 3:1 and approximately 1:6, and a weight ratio of the homopolymer of methacrylic acid or a salt thereof to the homopolymer of maleic acid or a salt thereof is between approximately 2:1 and approximately 1:4: and wherein the combined amount of homopolymer in the detergent is between about 2 and 9 weight percent and further wherein the detergent composition contains less than approximately 0.5% phosphorous by weight.

2. The detergent of claim 1, wherein the alkalinity source is selected from the group consisting of sodium hydroxide, potassium hydroxide, sodium carbonate, potassium carbonate and combinations thereof.

3. The detergent of claim 1, and further comprising a nonionic surfactant.

4. The detergent of claim 1, wherein the nonionic surfactant comprises an ethylene oxide/propylene oxide copolymer.

5. The detergent of claim 1, wherein the homopolymer of acrylic acid or the salt thereof has a molecular weight between approximately 300 and approximately 25,000 grams per mol.

6. The detergent of claim 1, wherein the homopolymer of methacrylic acid or the salt thereof has a molecular weight between approximately 400 and approximately 50,000 grams per mol.

7. The detergent of claim 1, wherein the homopolymer of maleic acid or the salt thereof has a molecular weight between approximately 200 and approximately 2,500 grams per mol.

8. The detergent of claim 1, wherein the detergent consists essentially of:

an alkali metal hydroxide;

the homopolymer of acrylic acid or the salt thereof;

the homopolymer of methacrylic acid or the salt thereof;

the homopolymer of maleic acid or the salt thereof;

at least one surfactant; and water.

9. A detergent composition comprising:

between approximately 1% and approximately 75% by weight alkalinity source;

between approximately 2% and approximately 9% by weight of a combination of homopolymers including a homopolymer of acrylic acid or salt thereof, homopolymer of methacrylic acid or salt thereof and, a homopolymer of maleic acid or salt thereof wherein the detergent composition contains less than approximately 0.5% phosphorous by weight.

10. The detergent composition of claim 9, wherein the alkalinity source is selected from the group consisting of sodium hydroxide, potassium hydroxide, sodium carbonate, potassium carbonate, and combinations thereof.

11. The detergent composition of claim 9, and further comprising between approximately 0.5% and 8% by weight a nonionic surfactant.

12. The detergent composition of claim 9, wherein the nonionic surfactant comprises an ethylene oxide/propylene oxide copolymer.

* * * * *